United States Patent [19]

Gostelow

[11] Patent Number: 4,889,104

[45] Date of Patent: Dec. 26, 1989

[54] AIR EXTRACTOR ARRANGEMENTS

[75] Inventor: Benjamin F. Gostelow, Clwyd, Wales

[73] Assignee: New World Domestic Appliances Limited, Cheshire, England

[21] Appl. No.: 273,080

[22] Filed: Nov. 18, 1988

[30] Foreign Application Priority Data

Nov. 20, 1987 [GB] United Kingdom ..... 8727170
May 27, 1988 [GB] United Kingdom ..... 8812704

[51] Int. Cl.[4] ..... F24C 15/20
[52] U.S. Cl. ..... 126/299 R; 98/115.4
[58] Field of Search ..... 98/115.1, 115.4; 126/299 R, 299 C, 299 D, 300, 301

[56] References Cited

U.S. PATENT DOCUMENTS 3,011,492 12/1961 Humbert ..... 126/299 R
3,031,946 5/1962 Watt et al. ..... 126/301 X
3,409,005 11/1968 Field ..... 126/299 R X
4,446,849 5/1984 McFarland ..... 126/299 R
4,501,260 2/1985 Grace ..... 126/299 R

FOREIGN PATENT DOCUMENTS 30916 2/1985 Japan ..... 126/299 D

*Primary Examiner*—Harold Joyce
*Attorney, Agent, or Firm*—Shlesinger & Myers

[57] ABSTRACT

An air extractor arrangement is adapted to be flush fitted in a kitchen work-top 4 and which comprises a fixed housing 1 which is coupled to an extractor fan 8, and a pop-out section 10 which is telescopically disposed within the housing 1, a linear bearing in the form of a slide bar assembly 12,13 being provided between the housing 1 and the pop-out section 10 by means of which the pop-out section 10 is supported in the housing 1. Arrangements are described for driving the pop-out section 10 either semi-automatically or fully automatically.

9 Claims, 3 Drawing Sheets

AIR EXTRACTOR ARRANGEMENTS

This invention relates to air extractor arrangements and is especially applicable to such arrangements for use in domestic kitchens In U.S. Pat. No. 4,501,260 there is disclosed a cooktop ventilation system in which a motor driven vent intake element is provided which can be raised above the level of the cooktop to a venting position and which can be retracted within the cooktop when not in use. Whilst the system disclosed in this patent has advantages over previously known ventilation systems, it is relatively expensive to implement in that it requires the vent intake element to be mounted on a mechanically complex scissor mechanism with guide rails, and also requires a mechanically complex motor driven crank wheel arrangement for raising and lowering the vent intake element. In addition, the system disclosed requires a blower to be mounted at the exhaust end of a venting duct which extends out of the unit e.g. at a wall or roof outlet, which means that the unit is not wholly self-contained.

Whilst the fully automatic system which is disclosed in U.S. Pat. No. 4,501,260 may be suitable for use with relatively expensive cooktop installations, it is felt that there is a need for an alternative, less expensive, self-contained, cooktop ventilation system which is not necessarily fully automatic e.g. the system may be semi-automatic in that the vent intake element may be raised automatically but lowered manually. The fact that the vent intake element may be lowered manually places severe constraints on the way it is slidably supported in the unit in that it must respond to pressure applied at the extreme ends of the element without jamming the element, and it is unlikely that the scissor mechanism disclosed in the aforesaid U.S Patent would be suitable.

It is an object of the present invention to provide an air extractor arrangement especially in the form of a cooktop ventilation system which is provided with an improved arrangement for supporting and driving the vent intake element, enabling either semi-automatic or fully automatic operation to be achieved.

According to the present invention there is provided an air extractor arrangement comprising a fixed housing, an extractor fan coupled to said fixed housing, a pop-out section having an air-intake, said fixed housing and said pop-out section being telescopically disposed one within the other, and a linear bearing provided between said fixed housing and said pop-out section by means of which said pop-out section is slidingly attached to said housing.

In a preferred arrangement the pop-out section will be disposed within the fixed housing In carrying out the invention it may be arranged that the fixed housing and the pop-out section are each of generally rectangular form, the pop-out section being movable from a first position in which it is substantially contained within said housing to a second position in which it projects from said housing.

Preferably, said pop-out section is movable vertically between said first position and said second position.

In one arrangement according to the invention, means, conveniently in the form of a tensator spring, will be provided for causing said pop-out section to be moved automatically from said first position to said second position, and it will also be arranged that said pop-out section is moved manually between said second position and said first position.

Conveniently, latch means will be provided for retaining said pop-out section in said first position, it being arranged that when said latch means is operated, said pop-out section is caused to be moved automatically from said first position to said second position.

In another arrangement according to the invention, motor drive means, conveniently in the form of a motor and worm drive cable arrangement, will be provided for causing said pop-out section to be moved automatically between said first position and said second position.

Preferably it may be arranged that said extractor fan is coupled to said fixed housing via a plenum chamber, in which case the linear bearing may be arranged to extend into said plenum chamber.

In an especially preferred form of the invention the air extractor arrangement will be adapted to be substantially flush fitted in a kitchen work-top.

Some exemplary embodiments of the invention will now be described reference being made to the accompanying drawings, in which.

Figure 1:
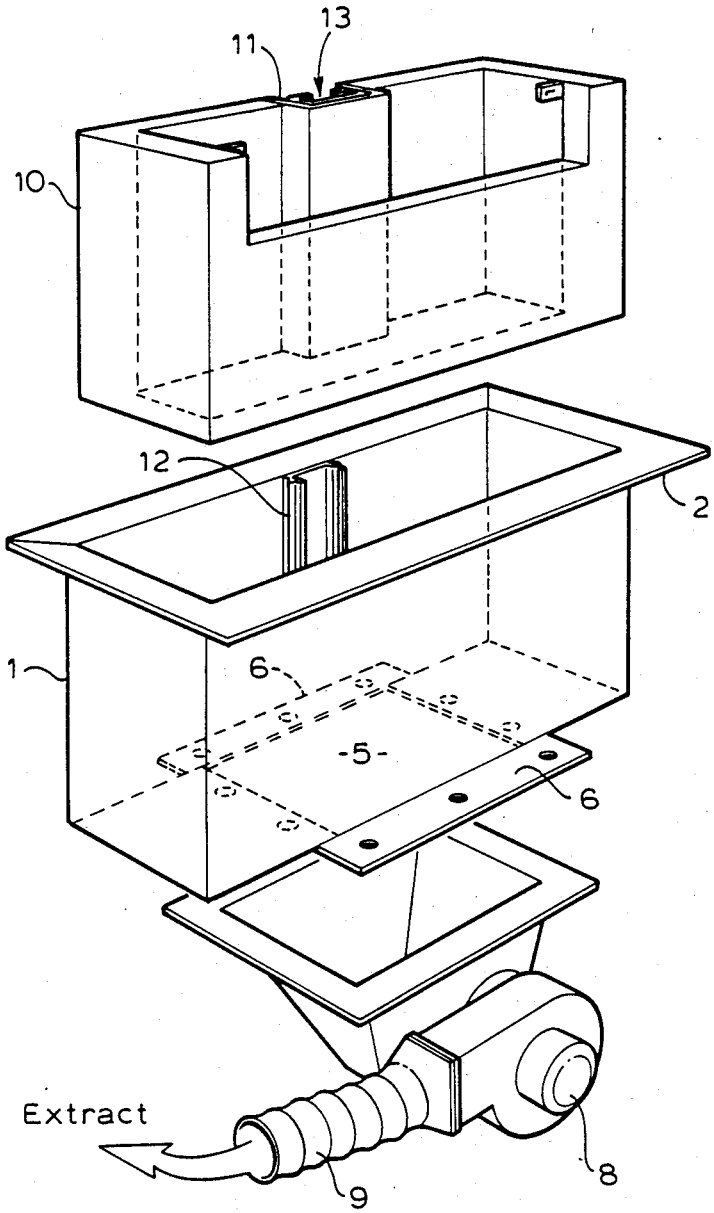
FIG. 1, is an exploded view depicting the main parts of a first air extractor arrangement in accordance with the present invention designed for semi-automatic operation.
Figure 2:
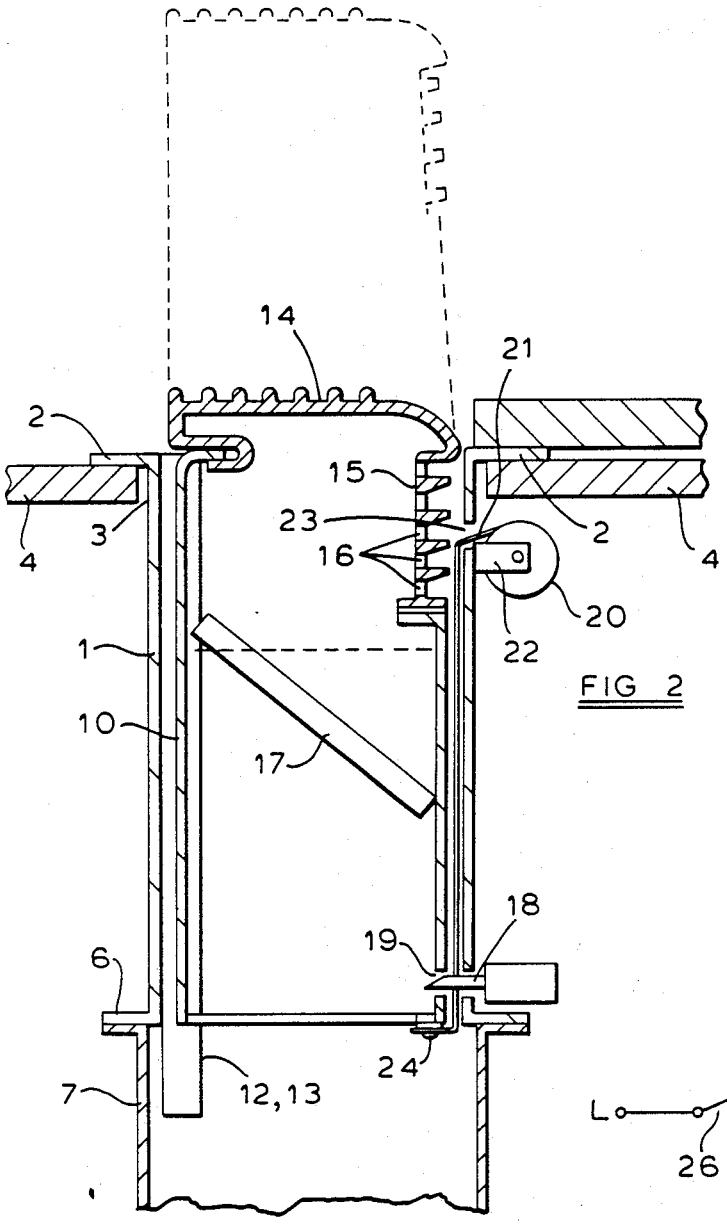
FIG. 2, is a partial side view of the air extractor arrangement of FIG. 1 fitted in a kitchen work-top.

In FIGS. 1 and 2 there is shown an air extractor arrangement which is designed to be flush fitted in a kitchen work-top, typically either behind a cooking hob or perhaps to one side of a cooking hob. Alternatively, the air extractor arrangement could be fitted as an integral part of a cooking hob.

The air extractor arrangement shown in FIGS. 1 and 2 comprises a fixed housing 1 which is of generally rectangular form and may typically be made of mild steel. The housing 1 is of open top construction with an outwardly extending peripheral flange 2 by means of which it is supported in a suitable slot 3 provided in a work-top 4 (FIG. 2). The bottom of the housing 1 is partially closed off and is provided with a rectangular hole 5 having outwardly extending flanges 6. To the bottom of the housing 1 and to the flanges 6 is secured a plenum chamber 7, and to the plenum chamber 7 is secured an extractor fan 8 by means of which air is sucked out of the housing 1 to be fed to a suitable outlet (not shown) via output duct 9.

Within housing 1 is telescopically disposed a pop-out section 10 also of generally rectangular form and also typically made of mild steel. The pop-out section 10 is made a reasonably close sliding fit in housing 1 to minimize the flow of air between them This air flow may be further minimized using conventional "draught-excluding" techniques. The pop-out section 10 is provided with a centrally located vertical channel 11 in which is disposed a linear bearing in the form of a ball-bearing type slide bar assembly by means of which the pop-out section 10 is slidingly attached to the housing 1. As depicted in FIG. 1, one bar 12 of the slide bar assembly is affixed to the inside of the housing 1 and the other bar 13 is affixed in the channel 11 to the pop-out section 10. In this way the pop-out section 10 is vertically movable between a first position in which the pop-out section 10 is fully contained within the housing 1 as depicted in full lines in FIG. 2, and a second position in which it projects from the housing 1 as depicted in dashed lines in FIG. 2. It will be noted that the bottom end of the slide bar assembly 12,13 extends into the plenum chamber 7 in order to reduce the overall height of the arrangement.

The pop-out section 10 is open at the bottom and is provided with a cut-away top and upper-front part over which fits an air intake grille 14 (shown in side section in FIG. 2). The front part 15 of the grille 14 is provided with a plurality of horizontally disposed slots 16 through which, when the pop-out section 10 is in its upper (second) position as shown in dashed lines in FIG. 2, air is drawn under the influence of extractor fan 8. In order to provide for filtering of the air drawn into the pop-out section 10, it is provided with one or more filter elements 17 which are disposed in the pop-out section 10. In order to provide for the periodic replacing of the filter element(s) 17, it may be arranged that the grille 14 is removable from the top of the pop-out section 10 thereby providing access to the filter element(s) 17.

In its normal out-of-use position, the pop-out section 10 is contained within the housing 1 and it is retained in this position by means of a spring biased solenoid operated latch 18 which extends through the housing 1 and into a slot 19 in the pop-out section 10 In order to arrange for the pop-out section 10 to be automatically moved to its raised (second) position when the latch 18 is operated, a tensator spring 20 consisting of a tightly coiled spring strip 21 is provided carried on a bracket 22 mounted on the outside of the housing 1, the end of the spring strip 21 passing through a slot 23 in the housing 1 and extending downwards between the housing 1 and the pop-out section 10 and being fixed to the underside of the pop-out section 10 by means of screw 24. The tensator spring 20 provides an upward bias on the pop-out section 10 so that when the latch 18 is operated, it is withdrawn from the slot 19 in the pop-out section 10 so allowing the pop-out section 10 to be raised under the action of the tensator spring 20. Movement of the pop-out section 10 back to its out-of-use (first) position, is effected by manually pressing the pop-out section 10 downwards, against the action of the tensator spring 20 until the latch 18 engages the slot 19 in the pop-out section 10.

In operation of the air extractor arrangement thus far described, it is important to ensure that the extractor fan 8 cannot operate when the pop-out section 10 is in its lowered position. This is achieved, as indicated in the circuit diagram of FIG. 3, by providing a micro-switch 25 which is used to detect when the pop-out section 10 is in its lowered position In this position the micro-switch 25 is used to energize the solenoid operated latch 18 under the control of an ON/OFF switch 26. Thus, when the ON/OFF switch 26 is set to "ON", the latch 18 operates to release the pop-out section 10 allowing it to be automatically raised under the action of the tensator spring 20. When the pop-out section 10 is raised, this is detected by the micro-switch 25 which then operates to remove the energization of the latch 18 and energizes the extractor fan 8. When the pop-out section 10 is again moved to its out-of-use position, this is detected by the micro-switch 25 which removes the energization of the extractor fan 8 and once again energizes the latch 18. However, in order for the latch 18 to engage the pop-out section 10, it is necessary for it to be de-energized, and this can only be effected by setting the ON/OFF switch 26 to "OFF".

Figure 3:
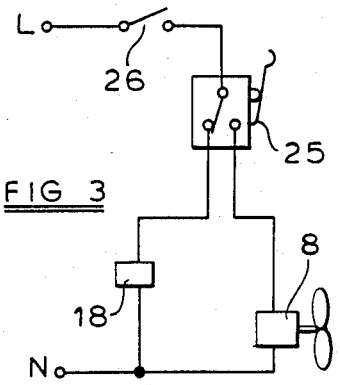
FIG. 3, is a circuit diagram relevant to the electrical operation of the arrangement of FIG. 2.
Figure 4:
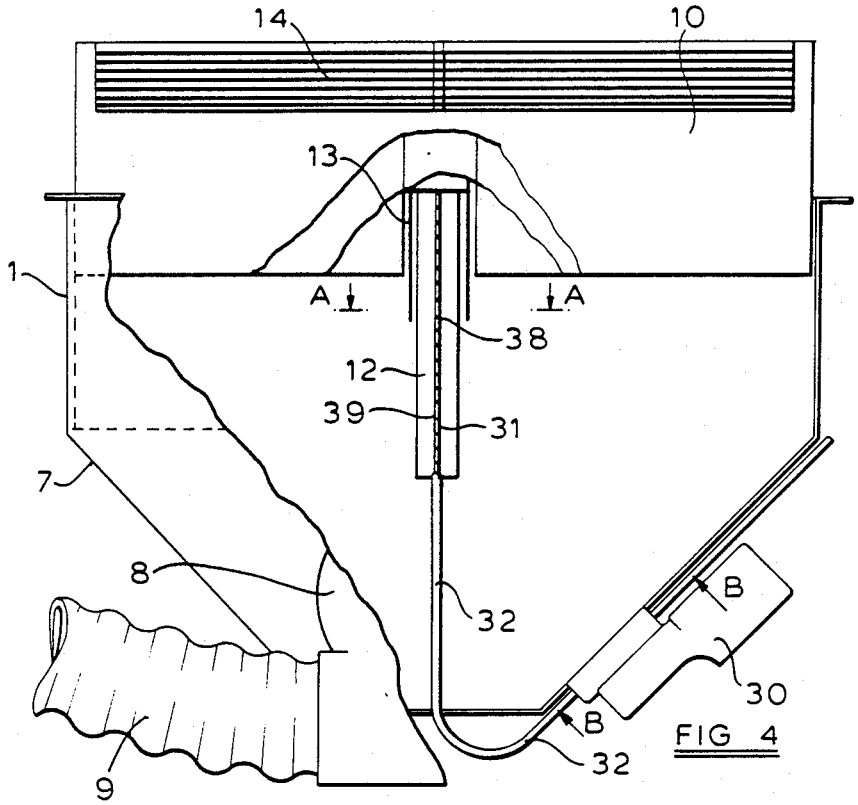
FIG. 4, is a partially cut-away front view of a second air extractor arrangement in accordance with the present invention designed for fully automatic operation.

In FIGS. 4 to 7 of the accompanying drawings there is shown an air extractor arrangement which is similar to that which has been described with reference to FIGS. 1 to 3, but which has been modified to provide for fully automatic operation of the pop-out section 10. In FIG. 4, parts of the air extractor arrangement which correspond to like parts in the embodiment of FIGS. 1 to 3 have been accorded the same reference numerals. The arrangement shown in FIG. 4 comprises a fixed housing 1 of generally rectangular form, to the bottom of which is fixed a plenum chamber 7. A fan 8 is secured to the plenum chamber 7, the fan being provided with an output duct 9.

Within housing 1 is telescopically disposed a pop-out section 10 which is slidingly supported in the housing 1 by means of a linear bearing in the form of a slide bar assembly comprising a slide bar 12 secured to the inside of the housing 1 and a slide bar 13 secured to the pop-out section 10.

In order to effect fully automatic lowering and raising of the pop-out section 10 a motor driven cable arrangement is provided. This comprises a motor and worm drive unit 30 which is attached to the outside of the plenum chamber 7 from which extends a cable 31, typically a Bowden cable, contained within a cable guide tube 32. The other end of cable 31 and cable guide tube 32 is coupled to the slide bar 12 which is secured to the inside of the housing 1 and is used to effect movement of the slide bar 13 which is secured to the pop-out section 10.

Figure 5:
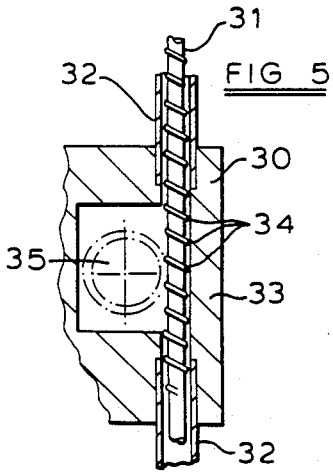
FIG. 5, is a cross-sectional view on the lines B—B of FIG. 4.

In FIG. 5 of the drawings there is shown a cross-sectional view on the lines B—B of the motor and worm drive unit 30 of FIG. 1. This depicts the cable 31 extending through a part of the housing 33 of the motor and worm drive unit 30, the cable 31 where it enters and exits the housing 33 being contained within the cable guide tube 32. The cable 31 has secured to it a helically wound wire 34 which forms a worm gear which co-operates with a gear wheel 35 such that when the gear wheel 35 is rotated by a motor (not shown), the cable 31 is moved axially within the cable guide tube 32. This axial movement of the cable 31 is used to effect raising and lowering of the pop-out section 10.

Figure 6:
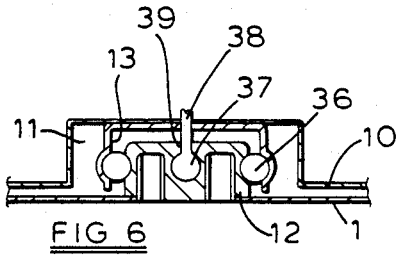
FIG. 6, is a cross-sectional view on the lines A—A of FIG. 4.

In FIG. 6 of the drawings there is shown a cross-sectional view on the lines A—A of FIG. 1 showing how the axial movement of the cable 31 is used to raise and lower the pop-out section 10. In FIG. 2, part of the side of the housing 1 is shown to which the slide bar 12 in the form of an aluminum extrusion is secured. The channel 11 in the side of the pop-out section 10 is also shown, in which is secured the other slide bar 13 of the slide bar assembly. Between the slide bars 12 and 13 are disposed a plurality of ball bearing type rolling elements 36 by means of which the slide bar 13 is slidingly supported on the slide bar 12. The aluminum extrusion slide bar 12 is provided with a vertical bore 37 in which the free end of the cable 31 is disposed, and in the lower part of the bore 37 is secured the free end of the cable guide tube 32. Thus, when the motor of the motor and worm drive unit 30 is operated, the end of the cable 31 within the bore 37 is moved vertically upwards and downwards dependent upon the direction of the motor.

To the end of the cable 31 is secured a driving spiggot 38 which extends outwards laterally through a vertical channel 39 in the side of the aluminum extrusion 12, the channel 39 extending from the bore 37 to the outer edge of the extrusion 12. The driving spiggot 38 extends into a slot (not shown) in the slide bar 13 and in the pop-out section 10 so that vertical movement of the cable 31 causes the driving spiggot 38 and thus the pop-out section 10 to be moved vertically Control of the upwards and downwards movement of the pop-out section 10 may be achieved by respective "UP" and "DOWN" push buttons which control the operation and direction of the motor of the motor and worm drive unit 30.

Figure 7:
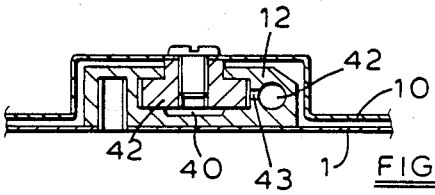
FIG. 7, is a cross-sectional view on the lines A—A of FIG. 4 of an alternative form of linear bearing.

Because in FIG. 4, the pop-out section 10 is power driven, the sliding friction between the slide bars 12 and 13 is no longer critical and it may be possible to use a sliding block arrangement in order to reduce costs. Such an arrangement is shown in FIG. 7 of the drawings. In this arrangement the slide bar 12 in the form of an aluminum extrusion is secured to the side of the housing 1. The aluminum extrusion is provided with a vertical channel 40, of generally "T" shaped cross-section in which is slidingly disposed a sliding block 41, typically of NYLATRON, the sliding block 41 extending out of the channel 40 and being secured to the pop-out section 10.

The aluminum extrusion 12 is also provided with a vertical bore 42 in which the cable 31 is disposed, and the cable 31 is provided with a driving spiggot 43, similar to the driving spiggot 38 of FIG. 6, which extends into a slot in the sliding block 42. Thus, vertical movement of the cable 31 effects vertical movement of the sliding block 42 and thus the pop-out section 10. Although in the embodiment of FIG. 4 one particular motor and cable drive arrangement has been described, it should be appreciated that other arrangements may also be used.

The operation of the air extractor arrangements described with reference to the accompanying drawings, when used in conjunction with an associated cooking hob, may be effected in a number of different ways. For example, it may be arranged that whenever a hob hot plate or burner is energized, the air extractor arrangement is automatically brought into use. In this case the speed of the extractor fan 8 may be fixed or may be varied by means of a separate "speed" control. Alternatively, a separate control may be provided to activate the air extractor arrangement, possibly in conjunction with an extractor fan speed control.

I claim:

1. An air extractor arrangement comprising a fixed housing, an extractor fan coupled to said fixed housing, a pop-out section having an air-intake, said fixed housing and said pop-out section being telescopically disposed one within the other, a linear bearing provided between said fixed housing and said pop-out section by means of which said pop-out section is slidingly attached in said housing, a drive motor, and a worm drive cable arrangement extending between said drive motor and said linear bearing whereby operation of said motor effects relative movement between said pop-out section and said fixed housing.

2. An arrangement as claimed in claim 1, in which the pop-out section is disposed within the fixed housing.

3. An arrangement as claimed in claim 2, in which the fixed housing and the pop-out section are each of generally rectangular form, and the pop-out section is movable from a first position in which it is substantially contained within said housing to a second position in which it projects from said housing.

4. An arrangement as claimed in claim 3, in which the pop-out section is movable vertically between said first position and said second position.

5. An arrangement as claimed in claim 1, in which said extractor fan is coupled to said fixed housing via a plenum chamber.

6. An arrangement as claimed in claim 5, in which the linear bearing extends into said plenum chamber.

7. An arrangement as claimed in claim 1, in which said pop-out section being adapted to be substantially flush fitted in a kitchen work-top.

8. An arrangement according to claim 1, in which said worm drive cable arrangement comprises a fixed outer casing and an inner cable within said outer casing which has a worm gear at one end engageable by said drive motor, the other end of said inner cable being used to effect relative movement between said pop-out section and said fixed housing.

9. An arrangement according to claim 8, in which said linear bearing comprises two parts, a first part being attached to said fixed housing and a second part being attached to said pop-out section, said first part having a bore therein for receiving said other end of said inner cable, said other end of said inner cable having means for driving said second part of said linear bearing.

* * * * *